US009255427B2

(12) United States Patent
Delande et al.

(10) Patent No.: US 9,255,427 B2
(45) Date of Patent: Feb. 9, 2016

(54) KEY HAVING A RETRACTABLE INSERT WITH LIMITED CLEARANCE

(71) Applicant: VALEO SECURITE HABITACLE, Créteil (FR)

(72) Inventors: Benoît Delande, Creteil (FR); Karim Namar, Creteil (FR)

(73) Assignee: VALEO SECURITE HABITACLE, Créteil (FR)

( * ) Notice: Subject to any disclaimer, the term of this patent is extended or adjusted under 35 U.S.C. 154(b) by 0 days.

(21) Appl. No.: 14/652,417

(22) PCT Filed: Dec. 17, 2013

(86) PCT No.: PCT/EP2013/076964
§ 371 (c)(1),
(2) Date: Jun. 15, 2015

(87) PCT Pub. No.: WO2014/095913
PCT Pub. Date: Jun. 26, 2014

(65) Prior Publication Data

US 2015/0330101 A1 Nov. 19, 2015

(30) Foreign Application Priority Data

Dec. 21, 2012 (FR) ..... 12 03573

(51) Int. Cl.
*A44B 15/00* (2006.01)
*E05B 19/04* (2006.01)

(52) U.S. Cl.
CPC ..... *E05B 19/043* (2013.01); *Y10T 70/8676* (2015.04); *Y10T 70/8757* (2015.04)

(58) Field of Classification Search
CPC ... E05B 19/043; E05B 19/0082; E05B 19/04; A45C 11/324; A47G 29/10; Y10T 70/8676; Y10T 70/8757
USPC ..... 70/257, 395–397, 399, 408, 456 R, 459; 24/3.6; 206/37.1–37.5, 37.8, 38.1
See application file for complete search history.

(56) References Cited

U.S. PATENT DOCUMENTS 6,499,326 B1 * 12/2002 Heussner ..... A45C 11/324 70/396
6,705,141 B1 * 3/2004 Jacob ..... E05B 19/043 70/278.3

(Continued)

FOREIGN PATENT DOCUMENTS

DE 10 2006 036503 A1 2/2008
WO 2011/061279 A1 5/2011

OTHER PUBLICATIONS

International Search Report issued in PCT/EP2013/076964 mailed on Jan. 21, 2014 (2 pages).

*Primary Examiner* — Lloyd Gall
(74) *Attorney, Agent, or Firm* — Osha Liang LLP

(57) ABSTRACT

A motor vehicle key includes a casing, an insert, a mechanism for deploying the insert, an upper rim of an upper area of the support, and a lower rim of a lower area of the support, the upper rim and the lower rim extending between a rotation end of the key and a blocking end, the upper area and the lower area forming a movement sector of the support, a first play between the rotation end and the support. The movement sector of the support includes at least one constriction point, exhibiting a second play, smaller than the first play, in relation to said support.

6 Claims, 2 Drawing Sheets

(56) References Cited

U.S. PATENT DOCUMENTS 8,695,389 B2 * 4/2014 Gueble ..... E05B 19/043 70/396
8,763,434 B2 * 7/2014 David ..... E05B 19/043 70/408
8,820,130 B2 * 9/2014 Delande ..... E05B 19/043 70/408
8,833,122 B2 * 9/2014 Konchan ..... E05B 19/043 206/37.2
8,978,429 B2 * 3/2015 Zhao ..... E05B 19/043 70/408
2009/0217722 A1 * 9/2009 Luo ..... E05B 19/043 70/459
2011/0179838 A1 * 7/2011 David ..... E05B 19/043 70/237

* cited by examiner

KEY HAVING A RETRACTABLE INSERT WITH LIMITED CLEARANCE

The present invention relates to a key, notably a motor vehicle key, having a retractable insert whose play is limited when the key is deployed.

The field of the invention is, in a general way, that of keys having retractable inserts. Keys of this type are frequently used in the motor vehicle field because they offer, notably, the advantage of having reduced overall dimensions when not in use; in fact, these keys may assume either a rest position, in which the key bit is folded back into the body of said key, or a use position, in which the insert emerges from the body of the key so that it can be introduced into a lock.

An example of a key of this type is shown in FIGS. 1-A to 1-D.

The key 1 shown in FIGS. 1-A to 1-D comprises a casing 3 forming the head of the key, an insert 5, 7 comprising a bit support 5 and a bit 7 integral with the support 5, and a mechanism for deploying the insert 5, 7 relative to the casing 3, to enable the insert 5, 7 to be moved between a rest position (FIGS. 1-C, 1-D) in which the insert 5, 7 is retracted into the casing 3 in a recess 9 which is provided within the casing 3 and is, for example, substantially L-shaped, corresponding to the shape of the insert 5, 7, and a position of use (FIG. 1-A) in which the insert 5, 7 is deployed relative to the casing 3 so that it can be inserted into a lock. The insert 5, 7 is most commonly made of Zamak (a zinc/magnesium/aluminum/copper alloy).

In the illustrated example, the casing 3 is made in two parts in the form of an upper half-shell 3*a* forming a cover, having an inner surface 41, and a lower half-shell 3*b* forming the bottom of the casing, having an inner surface 40. The inner surface 40 of the casing bottom 3*b* and the inner surface 41 of the cover 3*b* thus face toward one another. The two half-shells 3*a*, 3*b* can be assembled by clipping, for example. A sealing gasket (not shown) can be placed between the two half-shells 3*a*, 3*b* to protect the inside of the casing from the external environment, particularly from moisture or dust. It is also possible to provide a decorative band (not shown) between the two half-shells 3*a*, 3*b* to embellish the assembly.

The key 1 can also combine a mechanical key with an electronic key. In this case, a printed circuit card (not shown) is placed in the casing 3. This card carries the electronic remote control circuits for the central locking and unlocking of the openable body sections of the vehicle, together with a transponder (not shown) for the anti-theft system of the vehicle and a supply battery (not shown) for the remote control function. This remote control function is actuated by the operator by means of actuating buttons 11 provided on the upper half-shell 3*a*.

The support 5 also comprises two opposite ends 5*a*, 5*b*, of which the end 5*a* carries the bit 7. For this purpose, one end of the bit 7 can be fitted into a complementary housing (not shown) at the end 5*a* of the support 5. The assembly composed of the support 5 and the bit 7 is kept fixed, for example by means of a pin (not shown) passing through holes 17 formed in the support 5 and the bit 7. Clearly, the bit 7 can be fastened to the support 5 by any other suitable means. Additionally, the mechanism for deploying the insert 5, 7 comprises: a push button 19 received in a housing 21 associated with the upper half-shell 3*a* and passing through an opening 6 in the support 5, the push button 19 projecting from the upper half-shell 3*a* in order to be accessible to a user so that he can actuate this push button 19 to deploy the insert 5, 7, and a resilient return element 23 fastened by a first end 23*a* to the insert 5, 7 and by a second end 23*b* to an element blocked with respect to rotation relative to the casing 3, to bias the insert 5, 7 in a pivoting manner toward the position of use when the push button 19 is actuated. This return element 23 is a helical torsion spring. When the push button 19 is actuated by the user, the push button 19 is moved by axial translation along the longitudinal axis A within the support 5.

To prevent the push button 19 from bearing against the bottom wall of the support 5 at the end of its travel, a stop means may be provided for the push button 19. This stop means may comprise a stop block provided in the support 5, with which the push button 19 comes into contact at the end of its travel, so that the translational movement of the push button 19 is stopped before the push button reaches the bottom wall of the support 5. In the embodiment shown in FIGS. 1-C and 1-D, the support 5 has a cut-out in its bottom (FIG. 1-D), for example in the form of a circular arc of more than 180°, and the stop means comprises a stop block 15 (FIG. 1-C) formed on the lower half-shell 3*b* and inserted into the support 5 at the position of this circular arc. This stop block 15 also has a recess making it possible to define a surface 15*a* for contact with the push button 19 at the end of travel. The push button 19 also comprises a means for blocking the push button with respect to rotation relative to the casing 3. This blocking means forms a guide for the push button 19 in axial translation along the longitudinal axis A of the push button 19, and is made in one piece with the push button 19.

Thus the push button 19 makes it possible not only to actuate the deployment mechanism, but also to guide the push button 19 in translation, and to block the push button 19 with respect to rotation. In the illustrated example, this blocking means forming a guide comprises at least one guide lug 25 projecting outwards from the outer surface of the push button 19. The push button 19 may be provided with two diametrically opposed guide lugs 25, or alternatively with three regularly distributed guide lugs 25, for improved translational guidance.

The term "free space" of the key 1 signifies the internal space of the key occupied by the insert 5, 7 when the key is in the rest position. The support of the bit moves by rotation about the longitudinal axis A in a part of this free space during the transition from the rest position to the position of use and vice versa. The part of the free space in which the support 5 of the bit 7 moves during the transition from the rest position to the position of use of the key and vice versa is called the movement space of the support 5. It is delimited by part of the inner surface 41, called the upper movement area 43 of the support 5, of the upper half-shell 3*a* and part of the inner surface 40, called the lower movement area 42 of the support 5, of the lower half-shell 3*b*. The assembly composed of the upper movement area 43 and the lower movement area 42 is referred to by the expression "movement sector" of the support 5 of the bit 7. The upper movement area 43 of the support 5 has an upper rim 44, and the lower movement area 42 has a lower rim 45, the bit 7 projecting, in the position of use, at the location of the upper rim 44 and the lower rim 45 in the position of use of the key. The upper rim 44 and the lower rim 45 both extend between a first end, called the rotation end 46 of the key 1, the rotation of the bit 7 about the longitudinal axis A taking place at the rotation end 46, and a second end, called the blocking end 47 of the key 1, said blocking end 47 marking the stopping point of the bit 1 in its transition from the rest position to the position of use.

In keys of the type which has just been described, when they are in the position of use, a relatively large amount of play 48 is observed at the end of the deployed bit 7, as shown in FIG. 2-A and FIG. 2-B. This play is play in one direction, called the lateral direction, perpendicular to the direction of closure of the insert.

Such play may give rise to a number of problems: on the one hand, it leads to premature wear of the mechanism for opening and closing the insert, because of the friction that it causes; on the other hand, it gives the user an impression of fragility of the key.

The object of the invention is to overcome the aforementioned problems. The invention proposes a key with a retractable insert, having limited play at the end of the bit. For this purpose, the invention provides for the modification of the structure of certain parts of keys with retractable inserts. Thus the invention essentially relates to a key, notably for a motor vehicle, comprising:

a casing, with an upper half-shell forming a cover and a lower half-shell forming a bottom of the casing;

an insert, comprising a bit and a bit support, mounted pivotably relative to said casing between a rest position in which the insert is retracted into said casing and a position of use in which the insert is deployed relative to said casing;

a mechanism for deploying the insert mounted in said casing, comprising, notably, a push button;

an upper rim of an upper movement area, incorporated in an inner surface of the upper half-shell, of the support, and a lower rim of a lower movement area, incorporated in an inner surface of the lower half-shell, of the support, the upper rim and the lower rim extending between a key rotation end and a blocking end, the upper movement area and the lower movement area forming a movement sector of the support;

a first play between the rotation end and the support;

characterized in that the support movement sector comprises at least one constriction point, exhibiting a second play, smaller than the first play, in relation to said support.

In addition to the main characteristics mentioned in the preceding paragraph, the key according to the invention may have one or more supplementary characteristics from among the following characteristics, considered individually or in all technically possible combinations:

the constriction point is positioned at a blocking end of the upper rim and/or of the lower rim;

at least a part of the upper movement area of the support is inclined relative to the lower movement area;

the constriction point is not present at either the upper rim or the lower rim of the bit support movement sector;

the first play is of the order of 0.2 millimeter. It can thus vary by ten per cent above or below about 0.2 millimeter.

the second play is of the order of 0.05 millimeter. It can thus vary by ten per cent above or below about 0.05 millimeter.

Other characteristics and advantages of the invention will be more clearly evident from a reading of the following description, provided as an illustrative and non-limiting example, and from the appended drawings, of which:

FIG. 1-A shows a key according to the prior art;

FIG. 1-B shows the upper half-shell of the casing of the key of FIG. 1-A;

FIG. 1-C shows an exploded view of the key of FIG. 1-A;

FIG. 1-D is a perspective view from below of FIG. 1-C;

FIG. 2-A is a first perspective view of a prior art key illustrating a problem of lateral play;

FIG. 2-B is a second perspective view of a prior art key illustrating the problem of lateral play;

For greater clarity, identical or similar elements are indicated by identical reference symbols in all the drawings.

Figure 1A:
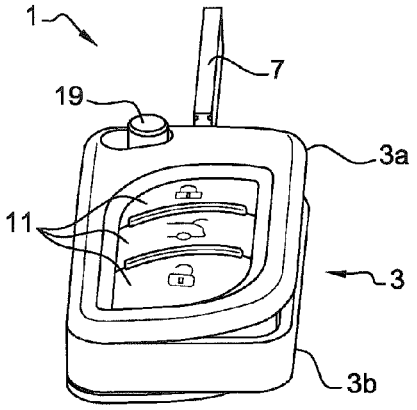
Figure 1B:
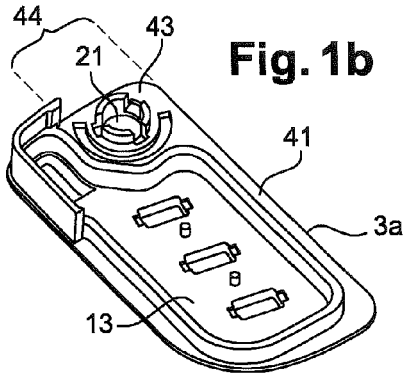
Figure 1C:
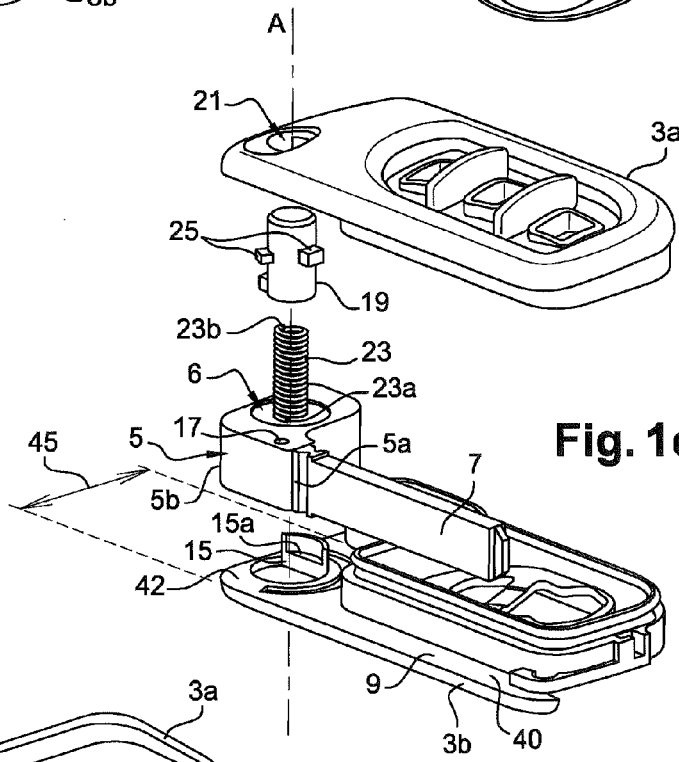
Figure 1D:
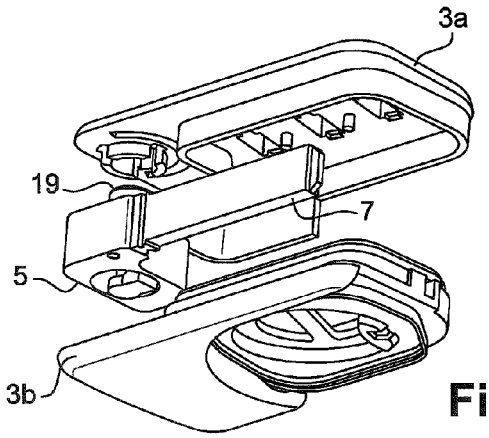
Figure 2A:
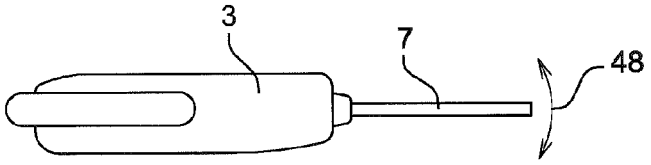
Figure 2B:
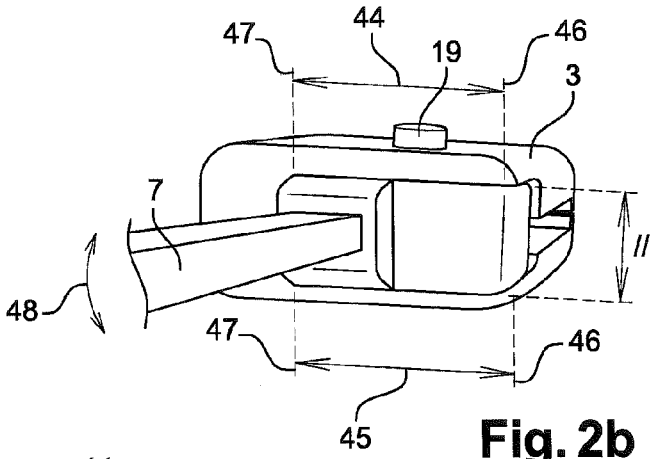
Figure 3:
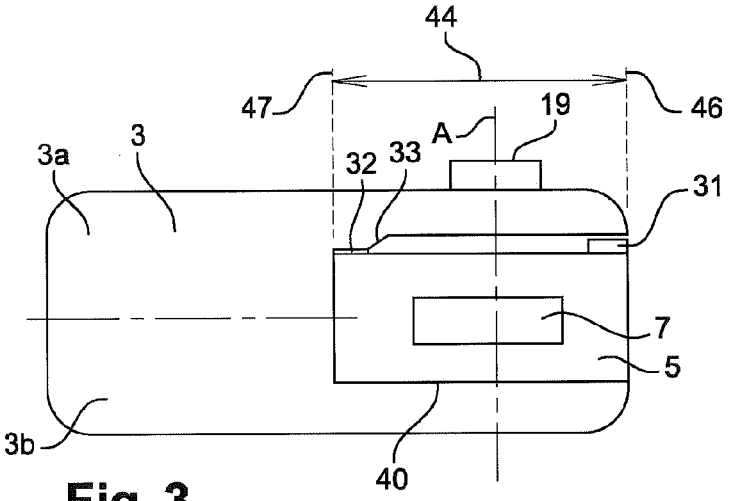
FIG. 3 is a schematic representation of a first exemplary embodiment of a key according to the invention.

Purely by way of example, a case is represented in which the play occurring between the body of the key and the bit support is present at the upper half-shell; in other exemplary embodiments of the invention, such play could obviously be present at the lower half-shell, or even at both half-shells, lower and upper.

The keys to which the invention relates are, notably, those described previously with reference to FIGS. 1-A to 1-D and 2-A to 2-B. However, they may differ, notably in respect of the deployment mechanism used to move from a rest position to a position of use. The overall structure of the keys according to the invention is similar to that of the preceding figures.

In keys according to the invention it is possible to identify, notably, the casing 3, the insert comprising the bit support 5 and the bit 7 integral with the support 5, the upper half-shell 3*a* forming a cover, having an inner surface 41, and the lower half-shell 3*b* forming the bottom of the casing, having an inner surface 40, the longitudinal axis A, the push button 19, the upper area of movement 43 of the support 5, the lower area of movement 42 of the support 5, the upper rim 44, the lower rim 45, the rotation end 46, and the blocking end 47 of the key 1.

In the invention, the problem of lateral play is overcome by acting in such a way that the upper area of movement 43 of the support 5 and the lower area of movement 42 of the support 5 are no longer strictly parallel. For this purpose, at least one constriction point is introduced in the upper area of movement 43 in order to limit a second play 32, present between the support 5 and the upper area of movement of the support 5, relative to a first play 31 present between the rotation end 46 and the support 5. The first play 31 has to remain relatively large, since it is located in an area where there is high mechanical pressure when the user presses the push button 19, and the rotation of the insert must not be blocked during its passage from the rest position to the position of use.

Figure 4:
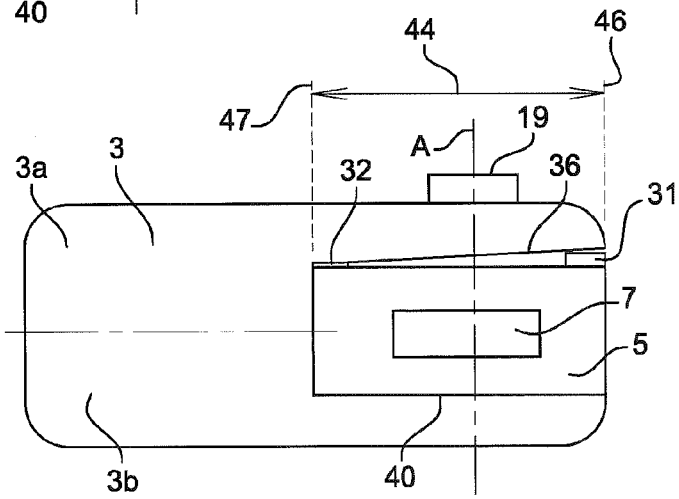
FIG. 4 is a schematic representation of a second exemplary embodiment according to the invention.

Thus, in the example of FIG. 4, it is proposed that a constriction point 33 be formed at the blocking end 47. In the example of FIG. 4, it is proposed that the lower surface of the cover 3*a* be made in the form of an inclined surface 36, where the set of points forming the inclined surface may be considered to be constriction point.

Advantageously, provision is made for the constriction point to be positioned not directly on the rim 44, but toward the inside of the key, while still remaining within the upper area of movement 43 of the support 5.

Advantageously, provision is made to reduce the second play 32 to a value substantially equal to 0.05 millimeter, the first play 31 having a value of 0.2 millimeter.

The invention claimed is:

1. A key for a motor vehicle, comprising:

a casing, with an upper half-shell forming a cover and a lower half-shell forming a bottom of the casing;

an insert, comprising a bit and a bit support, mounted pivotably relative to said casing between a rest position in which the insert is retracted into said casing and a position of use in which the insert is deployed relative to said casing;

a mechanism for deploying the insert mounted in said casing comprising a push button;

an upper rim of an upper movement area, incorporated in an inner surface of the upper half-shell, of the support, and a lower rim of a lower movement area, incorporated in an inner surface of the lower half-shell, of the support, the upper rim and the lower rim extending between a key rotation end and a blocking end, the upper movement area and the lower movement area forming a movement sector of the support;

a first play between the rotation end and the support;

characterized in that the movement sector of the support comprises at least one constriction point, exhibiting a second play, smaller than the first play, in relation to said support.

2. The key as claimed in claim 1, wherein the constriction point is positioned at a blocking end of the upper rim and/or of the lower rim.

3. The key as claimed in claim 1, wherein at least a part of the upper movement area of the support is inclined relative to the lower movement area.

4. The key as claimed in claim 1, wherein the constriction point is not present at either the upper rim or the lower rim of the movement sector of the support.

5. The key as claimed in claim 1, wherein the first play is of the order of 0.2 millimeter.

6. The key as claimed in claim 1, wherein the second play is of the order of 0.05 millimeter.

* * * * *